US005538325A

United States Patent [19]

Bullard

[11] Patent Number: 5,538,325

[45] Date of Patent: Jul. 23, 1996

[54] DROP-IN SEAT AND SPRING CLIP USABLE THEREWITH

[75] Inventor: Larry I. Bullard, High Point, N.C.

[73] Assignee: L&P Property Management Company, Chicago, Ill.

[21] Appl. No.: 272,129

[22] Filed: Jul. 8, 1994

[51] Int. Cl.[6] ..... A47C 7/00

[52] U.S. Cl. ..... 297/440.22; 297/463.1; 297/452.1

[58] Field of Search ..... 297/440.22, 452.52, 297/452.54, 463.1, 452.1; 267/110–112; 24/336, 339, 295

[56] References Cited

U.S. PATENT DOCUMENTS

| | | | |
|---|---|---|---|
| 710,477 | 10/1902 | Littell . | |
| 3,276,801 | 10/1966 | Jones | 267/110 X |
| 3,720,960 | 3/1973 | Bond | 267/110 X |
| 3,797,886 | 3/1974 | Griffiths | 297/452.52 X |
| 3,888,474 | 6/1975 | Mandusky et al. . | |
| 3,971,082 | 7/1976 | Crosby et al. . | |
| 4,037,829 | 7/1977 | Crosby et al. | 267/110 |
| 4,102,586 | 7/1978 | Pearson et al. | 267/110 X |
| 4,147,336 | 4/1979 | Yamawaki et al. . | |
| 4,247,089 | 1/1981 | Crosby et al. . | |
| 4,364,547 | 12/1982 | Crosby . | |
| 4,815,717 | 3/1989 | Crosby | 297/452.52 X |
| 4,815,789 | 3/1989 | Marcus | 297/440.22 |
| 5,232,266 | 8/1993 | Mork | 297/440.22 X |
| 5,409,198 | 4/1995 | Roick | 24/336 X |

FOREIGN PATENT DOCUMENTS

| | | | |
|---|---|---|---|
| 213246 | 8/1956 | Australia . | |
| 614340 | 5/1935 | Germany | 297/440.22 |

*Primary Examiner*—Milton Nelson, Jr.
*Attorney, Agent, or Firm*—Wood, Herron & Evans

[57] ABSTRACT

A spring frame assembly particularly adapted for use as a drop-in seat section includes a unique clip for securing each end of a sinuous spring to a metal frame member. The assembled spring unit can be dropped into a chair, seat or other article of furniture for attachment to and support by a framed portion of the chair or other article of furniture. With the spring clip, screws, staples, bolts, or other mechanical fasteners requiring specialized tooling and expertise for assembly are not required so that the spring assembly can be shipped from a spring manufacturer in a knocked down configuration and assembled at the furniture manufacturer for incorporation into an upholstered chair or other article of furniture.

12 Claims, 1 Drawing Sheet

DROP-IN SEAT AND SPRING CLIP USABLE THEREWITH

BACKGROUND OF THE INVENTION

This invention relates to seat assemblies, and more particularly, to a clip for attaching springs to a seat assembly for use as a drop-in seat component.

In the assembly of an upholstered chair or other furniture, sinuous springs have been widely used to provide a spring unit that is substantially less expensive than coil springs and provides satisfactory comfort. For example, U.S. Pat. No. 3,971,082 discloses sinuous spring bands which extend between and are attached to rail frame members in furniture. In the construction of upholstered chairs, it is common to use a spring assembly as a drop-in seat component. Furthermore, sinuous springs are commonly attached to a frame section for use as a drop-in component in the manufacture of the upholstered chair or other furniture.

Conventionally, such spring assemblies comprise wood rail frames with a plurality of sinuous springs stretched between opposing sides of the frame. Mechanical fasteners such as staples, nails, clips, bolts, and the like are used to secure the springs to the frame members. For example, U.S. Pat. Nos. 4,247,089 and 4,364,547 each disclose seat spring assemblies which have sinuous springs secured to wooden rails by staples. As an alternative to the wooden frame, steel rails, channels, angle irons, or other metallic frame members replace the wooden rails.

One problem associated with conventional spring unit assemblies as described, as for example those illustrated in U.S. Pat. Nos. 4,247,089 and 4,364,547, is the need for complicated tooling and connectors for securing the springs to the frame members. Assembly of the spring unit with complicated connectors, tooling and machinery requires a degree of skill and expertise in utilizing the specific attachment hardware and tools. As a result of the specialized tools and skills required to attach the springs to the frame, the spring unit components and assemblies are manufactured at the spring manufacturer. The unit is then shipped to the chair or furniture company only after it has been fully assembled by the skilled personnel at the spring company. As a result, the units must be shipped in at least a partially assembled configuration, thereby requiring assembly and increased shipping capacity by the spring company.

SUMMARY OF THE INVENTION

It has been a primary objective of this invention to provide an improved spring unit assembly which does not require complicated connectors and tooling or specialized skills to attach the springs to the furniture frame.

It has been a further objective of this invention to provide an improved spring unit assembly which can be shipped in a knocked-down (K-D) configuration for construction at the furniture manufacturer.

This invention features a novel clip for attaching a sinuous spring to a generally rectangular frame for use as a drop-in seat component in an upholstered chair or other furniture. The spring clip requires no specialized skill, tooling, or expertise for securing the spring to the frame. As a result, the individual components of the spring unit assembly can be shipped from the spring manufacturer to the furniture manufacturer in a knocked-down or disassembled configuration for assembly by the furniture manufacturer.

A drop-in seat section utilizing the spring clip of this invention includes a generally rectangular furniture frame upon which a generally rectangular spring frame is placed. The spring frame is constructed of metal frame members in which a pair of opposed frame members are either L-shaped angle members or U-shaped channel members. The sinuous springs extend between the opposed metal frame members in a generally bowed configuration for providing resilient support to the seat of the upholstered chair. Each end of each sinuous spring is secured to an upper leg of the metal frame member with the clip of this invention. The assembled spring frame is then dropped into a chair or other structure for support by the furniture frame.

The clip has a generally planar middle section with a pair of hooks being formed on opposing ends of the middle section. One of the hooks is open toward a lower or bottom surface of the middle section and is generally parallel with the middle section. The downwardly directed hook is clipped onto an upper leg of the metal frame member. The other hook on the clip is upwardly directed toward an upper surface of the middle section and is adapted to engage an end of the sinuous spring. Preferably, the upwardly directed hook is canted relative to the middle section of the clip to form an oblique angle with respect thereto. The snap-in attachment of the springs to each metal frame member permits assembly of the spring unit without the need for mechanical fasteners or complicated tools, time-consuming procedures, or specialized skills.

Because a spring unit assembly of this invention can be easily assembled, the spring frames, springs and clips can be compactly shipped in a knocked-down configuration from the spring manufacturer for later assembly at the furniture manufacturer, thereby reducing shipping and transportation costs and eliminating the hazards and dangers associated with the use of complicated tooling and fasteners. Alternatively, the spring unit can be assembled in steps as it is being installed in the frame.

The assembled spring unit can be conveniently positioned or dropped into the wooden or metal furniture frame of a chair, seat or other piece of furniture and secured thereto by nails, screws, or other combined fasteners. As a result, the spring unit assembly is referred to as a "drop-in seat". The metal frame of the spring unit assembly is supported by rails of the wooden or metal frame of the chair or other furniture. The spring unit assembly is easily dropped in place and supported by the furniture frame members, thereby reducing the need for complicated spring attachment mechanisms and providing a comfortable, easily assembled and sturdy chair or piece of furniture.

BRIEF DESCRIPTION OF THE DRAWINGS

The objectives and features of this invention will become more readily apparent from the following detailed description taken in conjunction with the accompanying drawings in which.

DETAILED DESCRIPTION OF THE INVENTION

Figure 1:
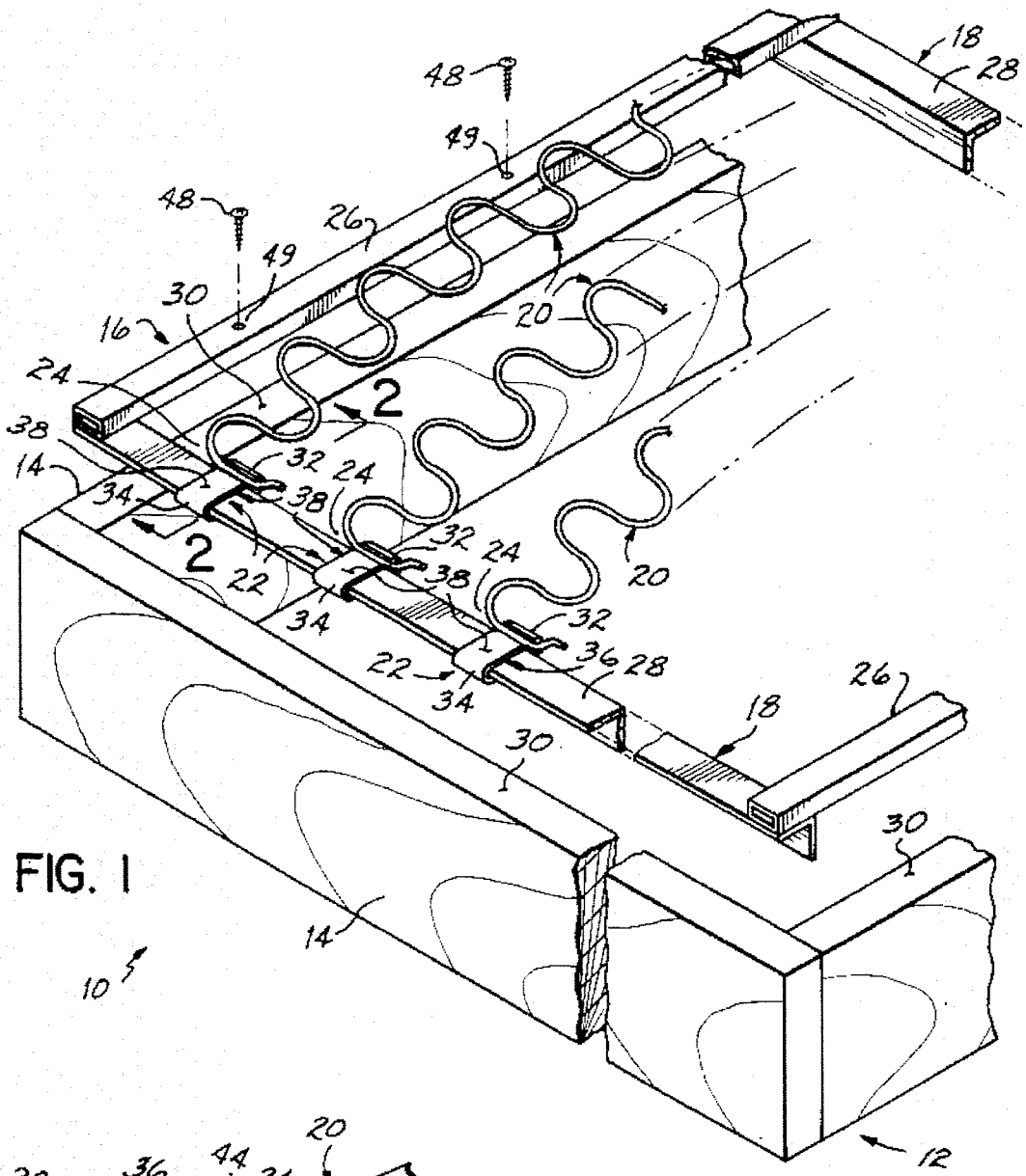
FIG. 1 is a partial perspective view of a spring unit assembly and furniture frame of this invention.

Referring to FIG. 1, a presently preferred embodiment of a seat assembly 10 incorporating the invention of this application comprises a frame 12 of a chair, seat or other article of furniture and a drop-in spring frame assembly 16. The furniture frame 12 is usually constructed of wooden rail members 14 and supports the drop-in spring frame assembly 16 thereon. The spring frame assembly 16 is preferably constructed of opposed metal frame members 18, a plurality of sinuous springs 20 extended between opposing metal frame members 18, and a plurality of clips 22 securing end portions 24 of the sinuous springs 20 to the frame members 18.

The spring unit frame 16 is generally rectangular and consists of a first pair of opposed parallel frame members 18 to which the clips 22 are attached and a second pair of opposed parallel frame members 26 which are connected to the ends of the first pair of frame members 18 and which extend parallel to the sinuous springs 20. The second pair of frame members 26 can be of any construction and configuration but are preferably metal and box shaped as shown in FIG. 1. The opposing frame members 18 to which the clips 22 are attached are preferably a section of generally L-shaped angle iron 18*a* (FIGS. 1–4) or generally U-shaped channel 18*b* (FIG. 5). The clips 22 are attached to an upper leg 28 of the L-shaped or U-shaped frame members 18.

As shown in FIGS. 1–4, the angle iron or L-shaped frame member 18*a* is oriented so that the upper leg 28 is directed outwardly from the center of the spring assembly 10 so that the spring unit frame 16 is supported by the furniture frame 12 with the upper leg 28 resting upon a top edge 30 of the wooden frame 12. The adjacent and opposing frame members 26, 18 are similarly configured as mirror images of those shown in FIG. 1.

Each sinuous spring 20 includes the end portion 24 which is secured into a first hook 32 of the clip 22. A second hook 34 of the clip 22 is formed onto the opposite end of a middle, generally planar section 36 of the clip 22 for attaching the clip 22 to the upper leg 28 of the frame member 18*a*. As shown particularly in FIGS. 2–4, the first hook 32 is open upwardly toward an upper surface 38 of the middle section 36 of the clip 22; whereas, the second hook 34 is open downwardly toward a bottom surface 40 of the middle section 36 of the clip 22. Furthermore, the first hook 32 is preferably joined to the middle section 36 at a bend 42 so that the first hook 32 is canted relative to the middle section 36 to form a generally oblique angle with respect thereto. The second hook 34 is generally parallel with the bottom surface 40 of the middle section 36. Each hook 32, 34 includes a bend or detent 44 therein to provide a restricted opening to securely retain either the spring end 24 or the frame member 18 therein.

Figure 2:
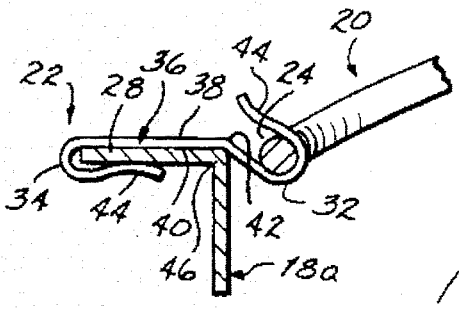
FIG. 2 is an enlarged cross-sectional view taken along line 2—2 of FIG. 1.

As shown particularly in FIG. 2, the upper leg 28 of the frame member 18*a* is retained within the second hook 34; whereas, the spring end portion 24 of the sinuous spring is retained within the first hook 32. With the clip 22 attached to the frame member 18*a*, the upper leg 28 is parallel to and underlies the middle section 36 and the clip 22 is configured so that the bend 42 of the spring clip is juxtaposed with and snaps over a bend or corner 46 in the frame member 18*a* for a more secure attachment of the clip 22 to the frame member 18*a*.

Figure 3:
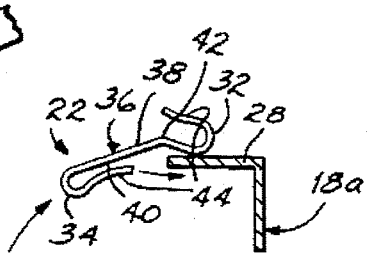
FIGS. 3 and 4 are views similar to FIG. 2 showing the attachment of the clip to the metal frame member and of the spring to the clip, respectively.
Figure 4:
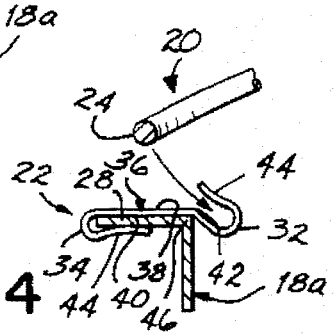
Figure 5:
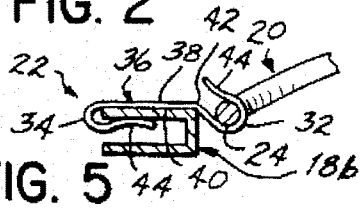
FIG. 5 is an enlarged cross-sectional view of a clip according to this invention secured to a U-shaped frame member.

As shown sequentially in FIGS. 3 and 4, the clip 22 is applied to the frame 16 by forcing the second hook 34 over the free edge of the upper leg 28 of the frame member 18*a* until the bend 42 is pulled over and around the corner 46 in the frame member 18*a*. Once the clip 22 is secured to the frame member 18*a*, the spring end 24 is snapped into the mouth of the first hook 32 and past the detent 44 as shown in FIG. 4 to thereby securely retain the sinuous spring 20 to the frame 16 without the need for complicated fasteners or specialized tooling. After both ends of the plurality of springs are secured to the frame 16 with the clips 22 as described, the spring assembly 10, is dropped into the seat frame 12 of a chair or other piece of furniture and secured thereto by nails, screws, or other conventional fasteners 48 through holes 49 in frame member 26.

Referring to FIG. 5, the generally U-shaped frame member 18*b* is shown with the clip 22 according to this invention secured thereto. The second hook 34 of the clip 22 is secured to the upper leg 28 of the frame member 18*b* and the first hook 32 retains the spring end portion 24 of the sinuous spring 20.

From the above disclosure of the general principles of the present invention and the preceding detailed description of a preferred embodiment, those skilled in the art will readily comprehend the various modifications to which the present invention is susceptible. For example, the spring unit frame 16 has been illustrated and described as a metal frame, but it could as well be made from extruded plastic components. Therefore, I desire to be limited only by the scope of the following claims and equivalents thereof.

I claim:

1. A drop-in seat section adapted to be dropped into and attached to a seating structure, the drop-in seat section comprising:

a generally rectangular frame, said frame having a pair of opposed metal frame members;

a plurality of sinuous springs extending in a generally bowed configuration between said opposed metal frame members, each said spring having spaced ends; and a sheet metal clip for attaching each said end of said spring to one of said metal frame members, said sheet metal clip having a middle section and a pair of hooks each being formed on opposing ends of said middle section, a first one of said hooks being open toward an upper surface of said sheet metal clip and a second one of said hooks being open toward a bottom surface of said sheet metal clip, one of said pair of hooks engaging said metal frame member and the other of said hooks engaging said end of said spring to thereby secure said spring to said rectangular frame.

2. The drop-in seat section of claim 1 wherein said first hook is open toward said upper surface of said sheet metal clip and engages said end of said spring, said second hook being open toward said bottom surface of said sheet metal clip and engaging said frame member.

3. The drop-in seat section of claim 1 wherein said pair of opposed metal frame members are U-shaped frame members, and said second hook which is open toward said bottom surface of said sheet metal clip engages an upper horizontal leg of said frame member.

4. The drop-in seat section of claim 3 wherein said second hook which is open toward said bottom surface and engaging said upper leg of said frame member is generally parallel with said middle section and is secured to said frame member without additional fasteners and said first hook which is open toward said upper surface and engaging said end of said spring is canted upwardly to be obliquely angled with respect to said middle section.

5. A spring assembly adapted to be dropped into and to form a seating portion of a seating structure, said spring assembly comprising:

a generally rectangular frame, said frame having a pair of opposed L-shaped metal frame members, each L-shaped frame member having an upper horizontal leg and a vertical leg depending downwardly from said upper horizontal leg;

a plurality of sinuous springs extending in a generally bowed configuration between said opposed metal frame members, each said spring having spaced ends; and a sheet metal clip for attaching each said end of said spring to one of said metal frame members, said sheet metal clip having a middle section and a pair of hooks each being formed on opposing ends of said middle section, a first one of said hooks being open toward an upper surface of said sheet metal clip and a second one of said hooks being open toward a bottom surface of said sheet metal clip, one of said hooks engaging said upper horizontal leg of said metal frame member and the other of said hooks engaging said end of said spring to thereby secure said spring to said frame member, said generally rectangular frame being adapted to be dropped into said seating portion of said seating structure with said upper horizontal legs supporting said spring assembly on the seating structure.

6. The spring assembly of claim 5 wherein said first hook which is open toward said upper surface of said sheet metal clip engages said end of said spring and said second hook which is open toward said bottom surface of said sheet metal clip engages said upper horizontal leg of said frame member.

7. The spring assembly of claim 6 wherein said second hook which is open toward said bottom surface and engages said upper horizontal leg of said frame member is generally parallel with said middle section and is secured to said frame member without additional fasteners and said first hook which is open toward said upper surface and engages said end of said spring is canted upwardly to be obliquely angled with respect to said middle section.

8. A seat comprising:

a generally rectangular frame portion, said frame portion having a pair of opposed metal frame members;

a plurality of springs extending between said opposed metal frame members, each said spring having spaced ends; and a sheet metal clip for attaching each said end of said spring to one of said metal frame members, said sheet metal clip having a middle section and a pair of hooks each being formed on opposing ends of said middle section, a first one of said hooks being open toward an upper surface of said sheet metal clip and a second one of said hooks being open toward a bottom surface of said sheet metal clip, one of said hooks engaging said metal frame member and the other of said hooks engaging said end of said spring to thereby secure said spring to said rectangular frame portion, wherein said pair of opposed metal frame members are generally U-shaped frame members, and said second hook which is open toward said bottom surface of said sheet metal clip engages a horizontal upper leg of said frame member.

9. The seat of claim 8 wherein said plurality of springs are sinuous springs and are secured to said frame portion in a generally bowed configuration.

10. The seat of claim 8 wherein said first hook which is open toward said upper surface of said sheet metal clip engages said end of said spring and said second hook which is open toward said bottom surface of said sheet metal clip engages said frame member.

11. The seat of claim 8 wherein said second hook which is open toward said bottom surface and engages said horizontal upper leg of said frame member is generally parallel with said middle section and is secured to said frame member without additional fasteners and said first hook which is oven toward said upper surface and engages said end of said spring is canted upwardly to be obliquely angled with respect to said middle section.

12. A drop-in seat section adapted to be attached to a seating structure, the drop-in seat section comprising:

a generally rectangular frame, said frame having a pair of opposed metal frame members, each said frame member being generally L-shaped;

a plurality of sinuous springs extending between said opposed L-shaped metal frame members, each said spring having spaced ends and being in a generally bowed configuration; and a sheet metal clip for attaching each said end of said spring to one of said L-shaped metal frame members, said sheet metal clip having a middle section and a pair of hooks each being formed on opposing ends of said middle section, one of said hooks being open toward an upper surface of said sheet metal clip, engaging said end of said spring and being canted relative to said middle section to form an oblique angle with respect thereto, the other of said hooks being open toward a bottom surface of said sheet metal clip, engaging an upper horizontal leg of said L-shaped metal frame member, being generally parallel with respect to said middle section and being secured to said L-shaped frame member without additional fasteners, upper horizontal legs of said L-shaped metal frame members supporting the seat section upon said seating structure.

* * * * *